United States Patent [19]

Blanchard, Jr.

[11] Patent Number: 4,689,922

[45] Date of Patent: Sep. 1, 1987

[54] BUFFING PAD

[76] Inventor: Walter W. Blanchard, Jr., 411 Lake Shore Dr., Duxbury, Mass. 02332

[21] Appl. No.: 830,627

[22] Filed: Feb. 18, 1986

[51] Int. Cl.[4] ..... B44D 1/00

[52] U.S. Cl. ..... 51/358; 15/230.18; 51/394; 51/400; 51/401

[58] Field of Search ..... 51/358, 394, 400, 401; 15/230–230.19

[56] References Cited

U.S. PATENT DOCUMENTS

| | | | |
|---|---|---|---|
| 3,007,289 | 11/1961 | Kent et al. | 15/230.18 |
| 3,683,567 | 8/1972 | Ali | 51/358 |
| 3,864,884 | 2/1975 | Weissman | 51/358 |

*Primary Examiner*—Frederick R. Schmidt
*Assistant Examiner*—Maurina Rachuba

[57] ABSTRACT

A plurality of control ribs are formed on a backing plate of a buffing pad. The buffing pad is releasably connected to a hand-held buffing machine. The control ribs provide increased flexibility toward the outer edge of the pad and provide an air flow pathway to direct dust away from the operator of the buffing machine.

12 Claims, 2 Drawing Figures

BUFFING PAD

BACKGROUND OF THE INVENTION

This invention relates to buffing pads for use in polishing or compounding a surface.

More specifically, this invention relates to an effective, easy-to-operate, reusable buffing pad which can be conveniently mounted on an associated hand-held buffing machine.

Buffing pads driven by portable hand-held buffing machines have a wide variety of cleaning and polishing functions. Such buffing pads are used on a wide variety of materials such as metals, plastics, fiberglass, and man-made marble. It is most important that the buffing pad be light and easy to control, yet sturdy enough to operate under a variety of conditions. It is also advantageous for the extremities of such a buffing pad to be flexible to aid in the polishing/cleaning function.

In addition, it is desirable to make the buffing process less fatiguing and problematic for the operator of the hand-held buffing machine by assuring that the buffing pad is properly balanced to avoid unnecessary vibrations. Since the operator of the hand-held duffing machine often has his or her face very close to the work area, it is desirable to decrease or eliminate the amount of dust or other debris, typically associated with the use of rubbing compounds and polishes, which may be directed toward the face of the operator.

In the past, buffing pads were typically coupled to buffing machines by use of awkward, stiff, removable, back-up plates, "T" nuts, or adaptors. These coupling mechanisms were time consuming and awkward to utilize. In addition, since it is deisrable to design a buffing pad which is reusable, it is important to solve the above prior art difficulties in a manner which does not interfere with the mass production cleaning of the buffing pad.

SUMMARY OF THE INVENTION

Briefly stated and according to an aspect of this invention, the problems associated with the prior art buffing pads have been substantially overcome by providing the buffing pad of this invention. This invention provides a light, reliable, cost-effective, and easy-to-clean, one-piece buffing pad. The invention includes a generally disk-shaped flexible backing plate which includes a plurality of control ribs integrally formed on an inner surface to control the flexibility of the backing plate and to provide a guide means for directing dust or other debris particles in a centrifugal direction away from the face of the operator of the associated hand-held buffing machine when the buffing pad is driven by the buffing machine. The inner surface of the backing plate also includes an integrally formed connecting means with a chamfered, threaded female portion for easy assembly with the associated buffing machine. The outer surface of the flexible backing pad is preferably roughened and glued to a nylon netting through which a tufted pad is attached.

It is therefore an object of this invention to provide a buffing pad which is easy to mount on an associated buffing machine and have good positive balance to substantially eliminate wobble, on idle, and also have improved balance during use.

It is a further object of this invention to provide a buffing pad which has more and uniform flexibility toward the periphery of the pad to increase control of the working tool (buffing pad), especially when the operator uses the buffing pad at an angle with respect to the work.

It is a still further object of the invention to provide a one-piece, light-weight buffing pad in which the central portion of the buffing pad is of improved strength, while still providing sufficient flexibility at the periphery of the pad.

It is still a further object of this invention to provide a buffing pad which is rigid enough to be safe (not break) yet flexible enough to give the operator a great deal of control during use.

It is a still further object of this invention to provide a buffing pad having a one-piece, light-weight backing plate which can be readily assembled onto an associated buffing machine, in a safe and sure manner, when the buffing machine is driving its threaded shaft.

It is a still another object of this invention to provide a buffing pad having a one-piece backing plate which lends itself to mass-production cleaning tenchiques.

Finally, it is a still further object of this invention to provide a buffing pad which includes strengthening control ribs which also create a desired air flow to aid in the removal of dust/debris away from the operator.

BRIEF DESCRIPTION OF THE DRAWING

The invention both as to its organization and principles of operation, together with further objects and advantages thereof, may better be understood by referring to the following detailed description of an embodiment of the invention taken in conjunction with the accompanying drawing in which.

DESCRIPTION OF A PREFERRED EMBODIMENT

Figure 1:
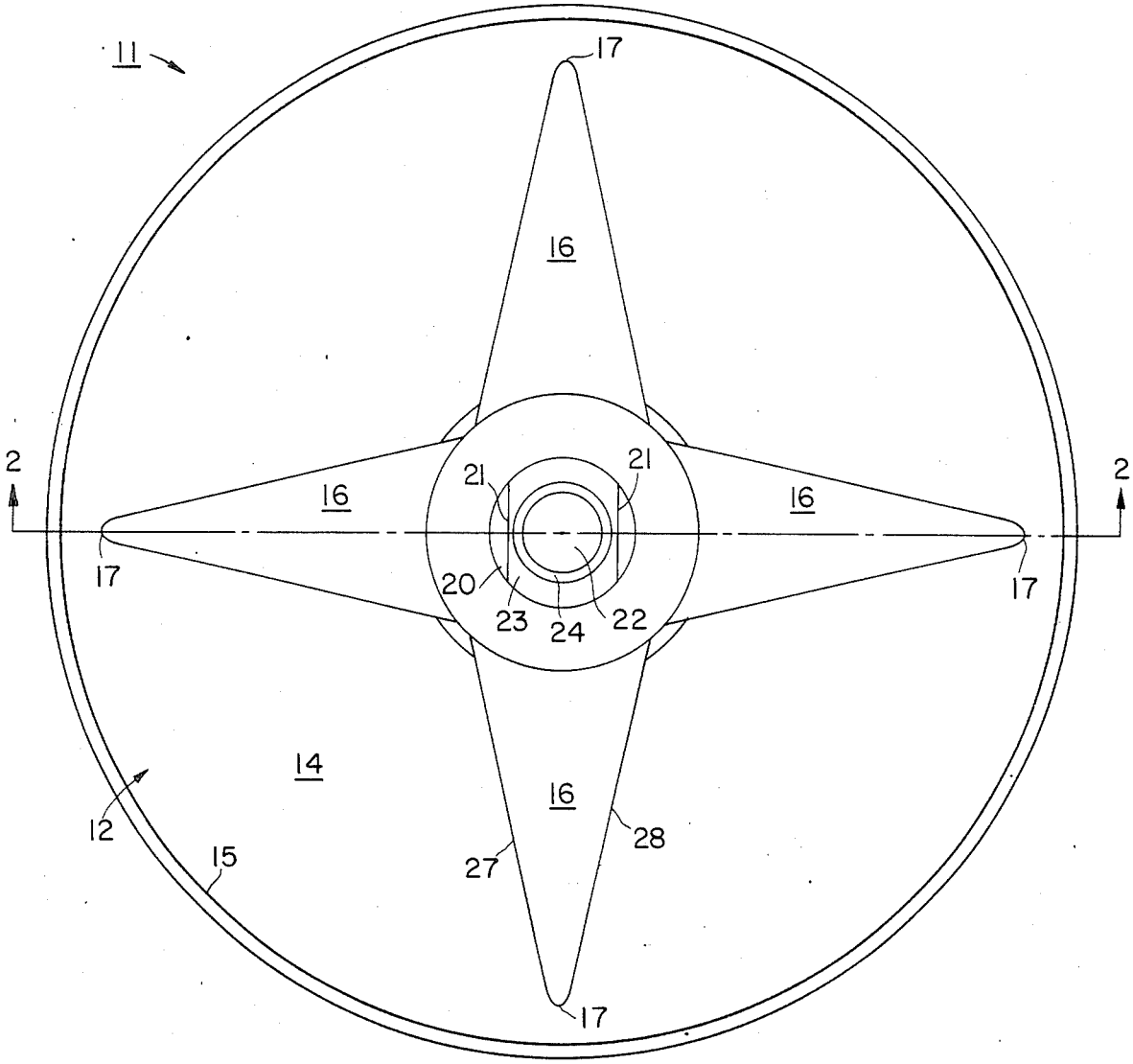
FIG. 1 is a top view of the backing plate of the buffing pad showing the inner surface of the backing plate, in accordance with this invention.
Figure 2:
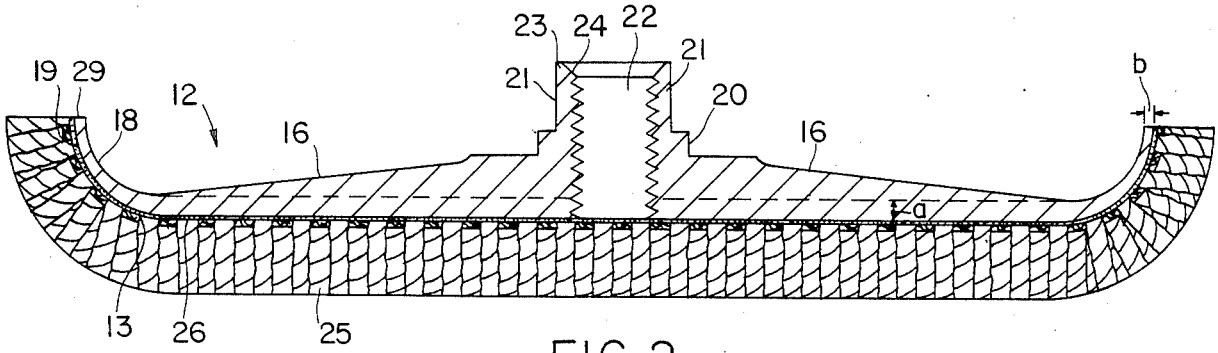
FIG. 2 is a side sectional view along lines 2—2 of FIG. 1 showing the contour of the rib structure and connecting means of the backing plate as well as the buffing means, in accordance with this invention.

Referring to FIG. 1 and FIG. 2, a generally disk-shaped, flexible backing plate 11 is formed having a generally concave inner surface 12 and a generally convex outer surface 13, best seen in FIG. 2. The backing plate 11 includes a generally planar central portion 14 which is integrally formed with a peripheral lip 15 of a predetermined curvature. The generally planar central portion 14 has a thickness "a", best seen in FIG. 2, of approximately one-quarter inch, while the peripheral lip 15 has a thickness "b" of approximatley one-sixteenth inch. The backing plate is preferably formed by injection molding of a rigid but flexible material such as a rubber-modified styrene sold under the tradename CHEVRON MC 2100.

The preferred backing plate 11 has a diameter of approximately seven inches measured from the inside edges of the peripheral lip 15 and weighs approximately four ounces.

Integrally formed on the inner surface 12 of the backing plate 11 are a plurality of tapering control ribs 16. The control ribs 16 are radially disposed on the inner surface 12 and taper in both width and thickness (best seen in FIG. 2) toward the peripheral lip 15 of the backing plate 11. The control ribs 16 are thickest toward the center of the backing plate 11 in order to provide additional support and strength for the backing plate 11 at the location of most stress (i.e., at the coupling portion of the buffing pad to an associated buffing machine). Each control rib 16 may have a thickness of four to five-tenths of an inch from the surface of the central portion 14 and taper down toward free end 17, at an angle of between six and seven degrees, to merge with the central portion 14 at or prior to the curvilinear surface of the peripheral lip 15. Each control rib also includes rounded sides 27, 28. The thickness, taper, width, and length may vary to achieve desired flexibility parameters associated with different applications.

Preferably each free end 17 of control rib 16 is generally rounded and terminates on the inner surface 12 at or prior to the approximate point at which the inner surface 12 transitions from a generally planar surface of the central portion 14 to the curvilinear surface of the peripheral lip 15. In a preferred embodiment, the curvilinear surface, which terminates at the edge 29 of peripheral lip 15, has an inner lip surface 18 having an approximate one-half inch radius and an outer lip surface 19 having an approximate five-eighth inch radius.

It has been discovered that the number of control ribs 16 is preferably four in number and disposed at 90° intervals in a symmetrical fashion on the central portion 14 of the inner surface 12. The combination of four control ribs 16, which are integrally molded to the inner surface 12 of backing plate 11 and in which each of the four symmetrically disposed ribs 16 taper in both thickness and length and terminate prior to the upstanding peripheral lip 15 of backing plate 11, renders a backing plate 11 which substantially prevents the buffing pad from wobbling on idle when the buffing pad is assembled to an associated buffing machine. Such a structure alsonprovides proper weight balance to the buffing pad and substantially eliminates any ripple effect during use. In addition, a buffing pad is realized in which flexibility increases toward the edge of the pad. That is, the control ribs 16 give sufficient rigidity to the backing plate while still imparting sufficient flexibility, especially at the periphery of the backing plate 11, to permit better and smoother control by an operator, in use.

In addition, it has been discovered that the use of four tapered support ribs disposed in a symmetrical fashion at 90° intervals on the inner surface 12 of backing plate 11 and terminating at or prior to the portion of the backing plate 11, which forms the inner lip surface 18 of peripheral lip 15, creates a desirable surface which aids in the removal of dust and other debris in a manner in which the dust and other debris are oriented away from the face of the operator.

The center of the central portion 14 of inner surface 12 of the backing plate 11 includes an integrally formed nut member 20. The upstanding nut member 20 includes flats 21 which may be used to remove the buffing pad from an associated buffing machine if the buffing pad gets stuck. The nut member 20 includes a threaded aperture 22 for mating with the threaded shaft of an associated buffing machine, such as a hand-held buffing machine.

The nut member 20 has its aperture 22 threaded at a depth sufficient to receive the mated threaded shaft of an associated buffing machine. The top portion 23 of nut member 20 forms a stop with the associated buffing machine. In addition, the top portion 23 includes chamfered portion 24 to aid in the hand of automatic assembly of the buffing pad to the associated buffing machine.

The integrally formed nut member 20 forms a coupling means which does not require the use of additional adaptors or the like. It is therefore possible for the operator of an associated buffing machine to couple the buffing pad on the threaded shaft of an associated buffing machine by merely positioning the rotating threaded shaft of the buffing machine into the threaded aperture 22 guided by chamfered portion 24. Likewise, removal can readily occur by reversing the procedure. Buffing machines for use as power drive devices for the buffing pad of this invention are well known in the art and are typically air or electrically driven and provide a single threaded shaft which rotates at approximately between 2400 and 2800 rpms.

Referring specifically to FIG. 2, the outer surfacew 13 of the backing plate 11 is shown to be roughened in order to increase the surface area of the outer surface 13 to provide a better surface for adhesive means, such as glue, in order to securely couple the buffing means 25. The buffing means 25 may take a variety of forms depending upon its ultimate use with important parameters being absorption and durability. Preferably the entire buffing pad, i.e. backing plate 11 with its mounted buffing means 25, will have sufficient integrity to withstand multiple cleanings in order to be reusable.

A typical buffing means 25 will be made of four ounces of 100% wool or a wool/polyester blend and have a pile height of about 1½ inches. The wool, or wool blend, is typically four ply and is eight-quad tufted onto a degreased nylon backing 26 in a manner well known in the art to result in about 25 threads to the inch. The buffing means 25 is glued on the nylon backing 26 and allowed to dry. The formed buffing means 25 with the nylon backing 26 is then press-fit, with glue, onto the outer surface 13 of the backing plate 11. In a preferred embodiment, the backing 26 is formed of nylon so that it will not absorb water. Preferably, the glue is a waterproof contact cement with a plastic-bonding additive.

While an embodiment and application of this invention have been shown and described, it will be apparent to those skilled in the art that many more modifications are possible without departing from the inventive concepts herein described. Therefore, the invention is not to be restricted except as is necessary by the prior art and by the spirit of the appended claims.

What is claimed as new and desired to be secured by Letters Patent of the United States is:

1. A one-piece buffing pad for use with a power drive member having a threaded shaft comprising:

a generally disk-shaped, flexible, solid, plastic backing plate having a generally planar central portion and an integrally formed peripheral lip of a thickness less than the thickness of said planar central portion and of a predetermined curvature thereby forming a generally convex outer surface and a generally concave inner surface;

buffing means;

means for permanently attaching said buffing means to said outer surface of said backing plate including said peripheral lip;

means for releasably connecting said backing plate directly to the threaded shaft of said power drive means, said connecting means being integrally connected to the center of said central portion of said inner surface and including a top portion for forming a stop with the power drive means; and a plurality of individual control ribs integrally formed on said central portion of said inner surface of said backing plate and extending from said connecting means in a radial direction toward the peripheral lip of said backing plate, each of said control ribs decreasingly tapering in both width and thickness from said connecting means toward the peripheral lip of said backing plate, with said control ribs having their greatest thickness and width at the connecting means, and their least thickness and width at a point near said peripheral lip, with said taper being continuous from said connecting means to said point near said peripheral lip, said control ribs providing increased flexibility to said backing plate toward the peripheral lip of said backing plate and said inner surface of said backing plate having unobstructed pathways between said ribs for directing debris particles in a generally centrifugal direction when the buffing pad is driven by the power drive member.

2. The buffing pad as in claim 1 wherein said buffing means includes a compounding or polishing pad.

3. The buffing pad as in claim 2 wherein said compounding or polishing pad includes a tufted material and further including a nylon backing net, said tufted material being attached to said backing net.

4. The buffing pad is in claim 3 wherein said entire outer surface of said backing plate is roughened and said means for attaching said buffing means to said outer surface includes glue, said buffing means being glued to said roughened outer surface of said backing plate.

5. The buffing pad as in claim 1 wherein said control ribs are four in number and include rounded sides and are symmetrically disposed at 90° intervals on said planar central portion of said inner surface of said backing plate.

6. The buffing pad as in claim 5 wherein each of said four control ribs includes a rounded tip portion, said tip portion extending on said inner surface of said backing plate to said peripheral lip.

7. The buffing pad as in claim 1 wherein said means for releasably connecting said backing plate to the threaded shaft of the power drive means includes a threaded shaft aperture having a chamfered free end to aid in alignment with the threaded shaft of the power drive member.

8. The buffing pad as in claim 7 wherein said flexible backing plate, said means for releasably connecting said backing plate to the power drive means, and said control ribs are all integrally formed of plastic.

9. A light-weight, one-piece portable buffing pad for use with a hand-held power drive member having a threaded shaft comprising:

a generally disk-shaped, flexible, solid, plastic backing plate having a generally planar central portion and an integrally formed peripheral lip of a thicknessnless than the thickness of saidi planar central portion, said lip being of a predetermined curvature thereby forming a generally concave inner surface and a generally convex outer surface, said outer surface, including the outer surface of said peripheral lip, being roughened;

a tufted pad;

means for permanently glueing said tufted pad to said outer surface of said backing plate including said peripheral lip;

means for releasably connecting said backing plate directly to the threaded shaft of the power drive means, said connecting means being integrally connected to the center of said central portion of said inner surface and including a top portion for forming a stop with the power drive means; and four control ribs symmetrically disposed at 90° intervals and integrally formed on said central portion of said inner surface of said backing plate and extending from said connecting means in a radial direction toward the peripheral lip of said backing plate, each of said control ribs decreasingly tapering in both width and thickness from said connecting means toward the peripheral lip of said backing plate, with said control ribs having their greatest thickness and width at the connecting means, and their least thickness and width at a point near said peripheral lip, with said taper being continuous from said connecting means to said point near said peripheral lip, said control ribs providing increased flexibility to said backing plate toward the peripheral lip of said backing plate and said inner surface of said backing plate having unobstructed pathways between said ribs for directing debris particles in a generally centrifugal direction when the buffing pad is driven by the power drive member.

10. The buffing pad as in claim 9 wherein each of said four control ribs includes a rounded tip portion, said tip portion extending on said inner surface of said backing plate to said peripheral lip.

11. The buffing pad as in claim 10 wherein said means for releasably connecting said backing plate to the power drive means includes a threaded shaft aperture having a chamfered free end to aid in alignment with the threaded shaft of the power drive member.

12. The buffing pad as in claim 11 wherein said flexible backing plate, said means for releasably connecting said backing plate to the power drive means, and said control ribs are integrally formed of plastic.

* * * * *